US008573966B2

(12) United States Patent
Ehara et al.

(10) Patent No.: US 8,573,966 B2
(45) Date of Patent: Nov. 5, 2013

(54) COMBUSTION APPARATUS

(75) Inventors: Hiroyuki Ehara, Niigata (JP); Akira Goto, Yokohama (JP)

(73) Assignees: Dainichi Co., Ltd., Niigata (JP); Nippon Oil Corporation, Tokyo (JP)

( * ) Notice: Subject to any disclaimer, the term of this patent is extended or adjusted under 35 U.S.C. 154(b) by 701 days.

(21) Appl. No.: 12/724,862

(22) Filed: Mar. 16, 2010

(65) Prior Publication Data

US 2010/0248173 A1 Sep. 30, 2010

(30) Foreign Application Priority Data

Mar. 27, 2009 (JP) ..... P2009-079429

(51) Int. Cl.
*F23D 11/44* (2006.01)
*F23D 14/12* (2006.01)
*F23D 14/46* (2006.01)

(52) U.S. Cl.
USPC ..... 431/211; 431/208; 431/217; 431/328; 431/350

(58) Field of Classification Search
USPC ..... 431/211, 350, 217, 208, 328
See application file for complete search history.

(56) References Cited

U.S. PATENT DOCUMENTS 2,272,423 A * 2/1942 Moore ..... 431/211
2,322,496 A * 6/1943 Workman ..... 431/166
3,357,471 A * 12/1967 Lyczko ..... 432/227
3,734,677 A * 5/1973 Murase et al. ..... 431/88
3,768,958 A * 10/1973 Sakai et al. ..... 431/208
3,847,534 A * 11/1974 Nomaguchi et al. ..... 431/329
3,964,859 A * 6/1976 Nishi et al. ..... 431/78
4,004,875 A * 1/1977 Zink et al. ..... 431/9
4,230,443 A * 10/1980 Berg et al. ..... 431/328
4,265,614 A * 5/1981 Satoda et al. ..... 431/329
4,280,806 A * 7/1981 King ..... 431/208
4,302,180 A * 11/1981 Le Mer ..... 431/218
4,369,027 A * 1/1983 Saito et al. ..... 431/333
4,397,632 A * 8/1983 Iritani et al. ..... 431/210
4,459,805 A * 7/1984 Kamiya et al. ..... 60/303
4,474,551 A * 10/1984 Iwai et al. ..... 431/351

(Continued)

FOREIGN PATENT DOCUMENTS

CN 1132839 10/1996
CN 1839095 9/2006

(Continued)

OTHER PUBLICATIONS

China Office action, mail date is Apr. 18, 2013.

*Primary Examiner* — Kenneth Rinehart
*Assistant Examiner* — William Corboy
(74) *Attorney, Agent, or Firm* — Greenblum & Bernstein P.L.C.

(57) ABSTRACT

To provide a combustion apparatus that has a vaporizer capable of vaporizing liquid fuel completely without complicating the structure of the combustion apparatus. The combustion apparatus has an evaporating part for heating and vaporizing the liquid fuel into combustion gas, and a premixed gas spout part for spouting out premixed gas in which the combustion gas is mixed with primary air, with an inflow port of the premixed gas spout part being provided at a position higher than the evaporating part. By configuring the combustion apparatus like this, a space for accumulating unvaporized liquid fuel is formed between the evaporating part and the inflow port, and sufficient time to completely vaporize the liquid fuel can be afforded. Therefore, unevaporated fuel in a liquid state can be prevented from flowing into the premixed gas spout part.

5 Claims, 2 Drawing Sheets

(56) References Cited

U.S. PATENT DOCUMENTS

| | | | | | |
|---|---|---|---|---|---|
| 4,606,719 | A * | 8/1986 | Mori et al. | 431/63 |
| 4,737,101 | A * | 4/1988 | Palmer | 431/12 |
| 4,776,787 | A * | 10/1988 | Hsie et al. | 431/208 |
| 4,879,959 | A * | 11/1989 | Korenberg | 110/264 |
| 4,909,728 | A * | 3/1990 | Nakamoto et al. | 431/176 |
| 4,988,287 | A * | 1/1991 | Stegelman et al. | 431/284 |
| 5,066,219 | A * | 11/1991 | Anzawa et al. | 431/10 |
| 5,113,478 | A * | 5/1992 | Nakashima et al. | 392/395 |
| 5,197,871 | A * | 3/1993 | Yamamoto et al. | 431/262 |
| 5,328,355 | A * | 7/1994 | Kobayashi et al. | 431/10 |
| 5,569,020 | A * | 10/1996 | Griffin et al. | 431/7 |
| 5,803,725 | A * | 9/1998 | Horn et al. | 431/187 |
| 5,810,577 | A * | 9/1998 | Ledjeff | 431/170 |
| 5,888,059 | A * | 3/1999 | Edwards et al. | 431/9 |
| 6,065,957 | A * | 5/2000 | Kondo et al. | 431/116 |
| 6,354,110 | B1 * | 3/2002 | Alchalabi et al. | 65/134.4 |
| 6,638,058 | B1 * | 10/2003 | Mainusch et al. | 431/187 |
| 6,748,745 | B2 * | 6/2004 | Ul Karim et al. | 60/777 |
| 6,866,503 | B2 * | 3/2005 | Ladharam | 431/10 |
| 6,890,498 | B2 * | 5/2005 | Tsiava et al. | 423/220 |
| 6,918,757 | B2 * | 7/2005 | Nakamura et al. | 431/89 |
| 7,610,761 | B2 * | 11/2009 | Carroni et al. | 60/777 |
| 2002/0197574 | A1 * | 12/2002 | Jones et al. | 431/8 |
| 2004/0166451 | A1 * | 8/2004 | Watanabe | 431/4 |
| 2007/0028522 | A1 | 2/2007 | Mizusawa et al. | |
| 2008/0160467 | A1 * | 7/2008 | Shimazu et al. | 431/174 |
| 2008/0193886 | A1 * | 8/2008 | Amano et al. | 431/9 |
| 2009/0123882 | A1 * | 5/2009 | Eroglu et al. | 431/8 |
| 2009/0186310 | A1 * | 7/2009 | Evertz et al. | 431/350 |
| 2009/0291401 | A1 * | 11/2009 | Nakagawa et al. | 431/181 |
| 2010/0136378 | A1 * | 6/2010 | Lee et al. | 429/19 |
| 2011/0094239 | A1 * | 4/2011 | Koizumi et al. | 60/776 |
| 2012/0085973 | A1 * | 4/2012 | Jungst et al. | 252/372 |
| 2012/0148925 | A1 * | 6/2012 | Grannell et al. | 429/408 |

FOREIGN PATENT DOCUMENTS

| | | | |
|---|---|---|---|
| JP | 63-156907 | | 6/1988 |
| JP | 63-210507 | | 9/1988 |
| JP | 08135926 | A * | 5/1996 |
| JP | 2008-170030 | | 7/2008 |
| WO | WO 2007003649 | A1 * | 1/2007 |

* cited by examiner

COMBUSTION APPARATUS

BACKGROUND OF THE INVENTION

1. Field of the Invention

The present invention relates to a combustion apparatus for combusting premixed gas of combustion gas vaporized from liquid fuel and primary air.

2. Related Background Art

There has been conventionally known a combustion apparatus that has a vaporizer heated by a heater, supplied with liquid fuel, and generating combustion gas by heating and vaporizing the liquid fuel. The generated combustion gas is mixed with primary air to obtain premixed gas, which is then spouted out from a burner and combusted.

In such a combustion apparatus, if the liquid fuel is not vaporized sufficiently in the vaporizer, the liquid fuel that is not completely vaporized is deposited in the form of tar, causing poor vaporization, or the fuel reaches the burner directly as liquid, causing poor combustion. For this reason, various improvements have been made in order to vaporize the liquid fuel completely.

For example, Japanese Patent Application Publication No. 2008-170030 contrives a burner that has a vaporizer structured to spray primary air and liquid fuel into a vaporizing chamber to generate premixed gas, and further spray the premixed gas generated in the vaporizing chamber into a vaporizing mixing chamber, thereby completely vaporizing the liquid fuel that is not completely vaporized in the vaporizing chamber.

With this configuration, vaporization can be performed twice in the vaporizing chamber and the vaporizing mixing chamber, making the vaporization efficiency higher than that of the conventional technology.

SUMMARY OF THE INVENTION

However, important ingredients necessary for vaporizing the liquid fuel are not only the inner volume and surface area of the vaporizer but also time for evaporating the liquid fuel. In other words, if time required for evaporating the liquid fuel is not provided when the opportunities of vaporization increases, the liquid fuel cannot be vaporized completely.

Therefore, it is necessary to devise means for providing the liquid fuel with adequate time to evaporate and preventing the fuel from flowing out in an intermediate stage of vaporization.

The present invention is to solve the problem described above, and an object thereof is to provide a combustion apparatus that has a vaporizer capable of vaporizing liquid fuel completely without complicating the structure of the combustion apparatus.

The present invention is a combustion apparatus, having: a heater for heating a vaporizer; an evaporating part for heating and vaporizing liquid fuel into combustion gas; a vaporizing chamber for mixing the combustion gas with primary air to obtain premixed gas; a premixed gas spout part communicated with the vaporizing chamber and having an inflow port and spout port; and a burner part provided vertically below the vaporizer and combusting the premixed gas, wherein the inflow port of the premixed gas spout part is provided at a position higher than the evaporating part.

The combustion apparatus is characterized in that a hole length of the premixed gas spout part is larger than a diameter of the inflow port.

The combustion apparatus is characterized in that the premixed gas spout part and the burner part are arranged coaxially.

Furthermore, the combustion apparatus is characterized in further having a hydrogen-containing gas supply tube for supplying hydrogen-containing gas, wherein the burner part combusts the premixed gas and the hydrogen-containing gas.

In addition, the combustion apparatus is characterized in that the burner part has a flame plate that has, at the center thereof, a premixed gas spout hole for spouting out the premixed gas, a hydrogen-containing gas spout hole for spouting out the hydrogen-containing gas to an outer circumference of the premixed gas spout hole, and a secondary air spout hole for spouting out secondary air to an outer circumference of the hydrogen-containing gas spout hole.

By configuring the combustion apparatus as described above, the liquid fuel can be provided with adequate time to vaporize, and the liquid fuel that is not vaporized can be prevented from flowing out of the vaporizing chamber.

DESCRIPTION OF THE PREFERRED EMBODIMENTS

Embodiments of the present invention, which are considered preferable, are now described simply by illustrating the functions of the present invention.

The present invention is a combustion apparatus, which has a vaporizer for generating premixed gas of combustion gas vaporized from liquid fuel and primary air, and combusts this premixed gas using a burner part provided vertically below the vaporizer.

Specifically, the liquid fuel supplied to the vaporizer is heated and thereby vaporized into combustion gas by an evaporating part. This combustion gas is mixed with the primary air by a vaporizing chamber to obtain the premixed gas. Thereafter, the premixed gas flows from an inflow port into a premixed gas spout part and is spouted out of a spout port toward the burner part.

Because the inflow port of the premixed gas spout part is provided at a position higher than the evaporating part, a space serving as a tray for receiving the liquid fuel is formed between the evaporating part and the inflow port. By accumulating unvaporized liquid fuel in this space, adequate time for completely vaporizing the liquid fuel can be provided, so that the unevaporated fuel in a liquid state can be prevented from flowing into the premixed gas spout part. In other words, the fuel contained in the premixed gas spouted out from the spout port becomes the combustion gas that is completely vaporized, and the combustion state in the burner part can be maintained well.

The combustion apparatus of the present invention is described hereinafter in detail with reference to the drawings.

The present invention is a combustion apparatus for combusting premixed gas of combustion gas and primary air. The present embodiment explains a case in which a reforming apparatus for generating hydrogen-based modified gas from raw fuel (hydrogen feedstock), such as hydrocarbon, is used as the combustion apparatus.

Figure 1:
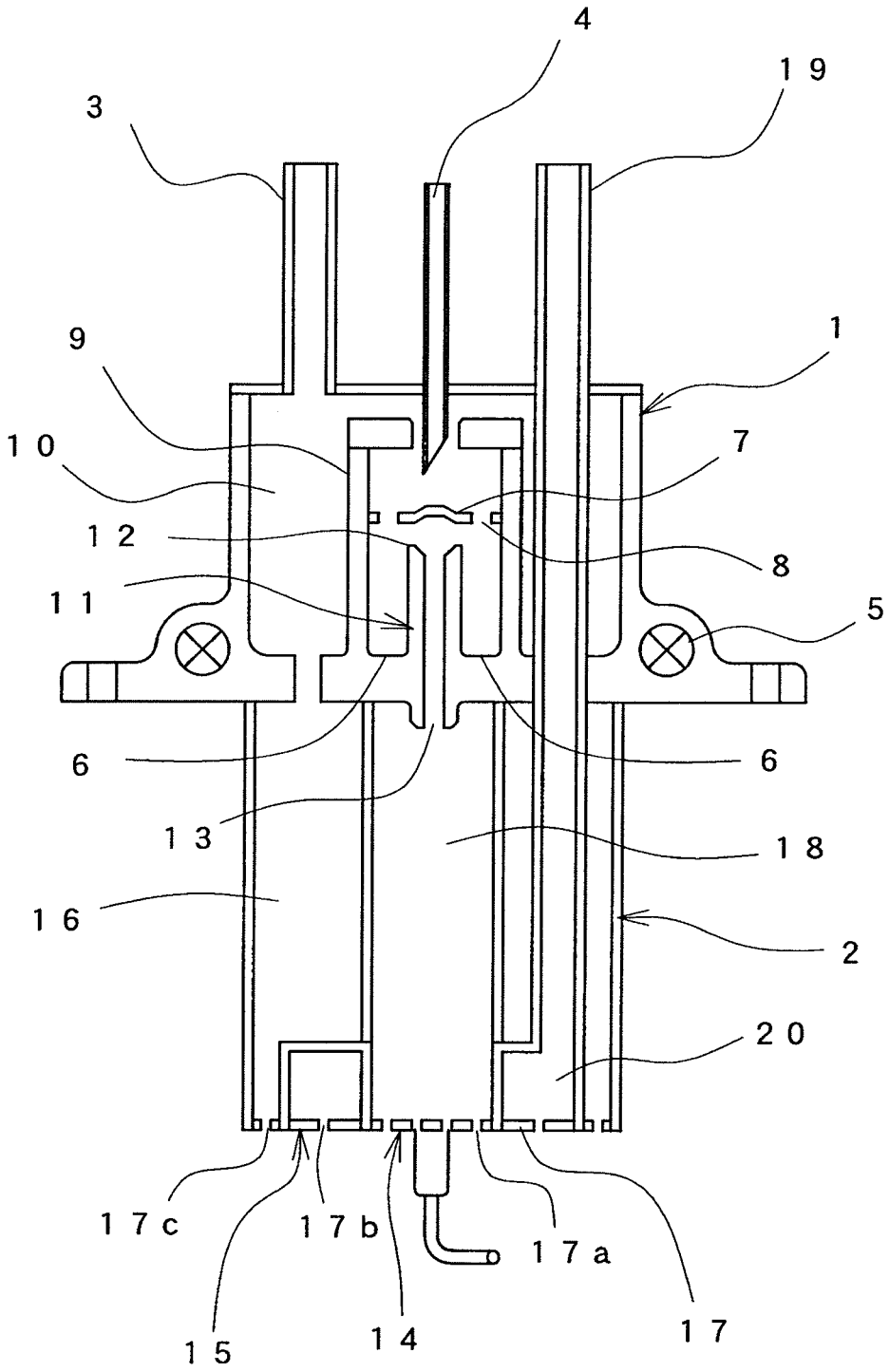
FIG. 1 is a front cross-sectional diagram of a combustion apparatus of the present invention.

FIG. 1 is a front cross-sectional diagram of the combustion apparatus that is provided with a vaporizer 1 for creating premixed gas of combustion gas vaporized from liquid fuel and primary air, a burner part 2 for combusting the premixed gas and hydrogen-containing gas generated by a fuel cell, and an air blowing passage 3 for supplying air.

The vaporizer 1 is structured to have a liquid fuel supply tube 4 for supplying the liquid fuel to the vaporizer 1, a heater 5 for increasing the temperature of the vaporizer 1, an evaporating part 6 for heating and vaporizing the liquid fuel into combustion gas, a partition plate 7 having a drip hole 8 for dispersing the liquid fuel and allowing the liquid fuel to drip into the evaporating part 6, a vaporizing chamber 9 having the evaporating part 6 on an inner bottom surface thereof and mixing the combustion gas with the primary air to obtain the premixed gas, an air supply chamber 10 accommodating the air from the air blowing passage 3 and dividing the air into the primary air mixed with the combustion gas and secondary air that is supplied to a flame formed in the burner part 2, and a premixed gas spout part 11 spouting out the premixed gas.

The premixed gas spout part 11 has an inflow port 12 which is communicated with the vaporizing chamber 9 and into which the premixed gas flows, and a spout port 13 spouting out the premixed gas. The inflow port 12 is provided at a position higher than the evaporating part 6.

The burner part 2 is configured by a premixed gas burner 14 for combusting the premixed gas, a hydrogen-containing gas burner 15 for combusting the hydrogen-containing gas, a secondary air passage 16 communicated with the air supply chamber 10 and supplying the secondary air to the flame formed in the burner part 2, and a flame plate 17 provided with a plurality of perforating spout holes. The burner part 2 is provided vertically below the vaporizer 1.

The premixed gas burner 14 is configured by a cylindrical premixed gas passage 18. The premixed gas injected from the spout port 13 of the premixed gas spout part 11 is supplied to this premixed gas passage 18.

The hydrogen-containing gas burner 15 is structured to have a hydrogen-containing gas supply tube 19 for supplying the hydrogen-containing gas generated by the fuel cell, and a hydrogen-containing gas chamber 20 provided, in a connected row arrangement, with a downstream end of the hydrogen-containing gas supply tube 19. The hydrogen-containing gas discharged from a hydrogen electrode of the fuel cell is supplied to the hydrogen-containing gas chamber 20 through the hydrogen-containing gas supply tube 19.

Figure 2:
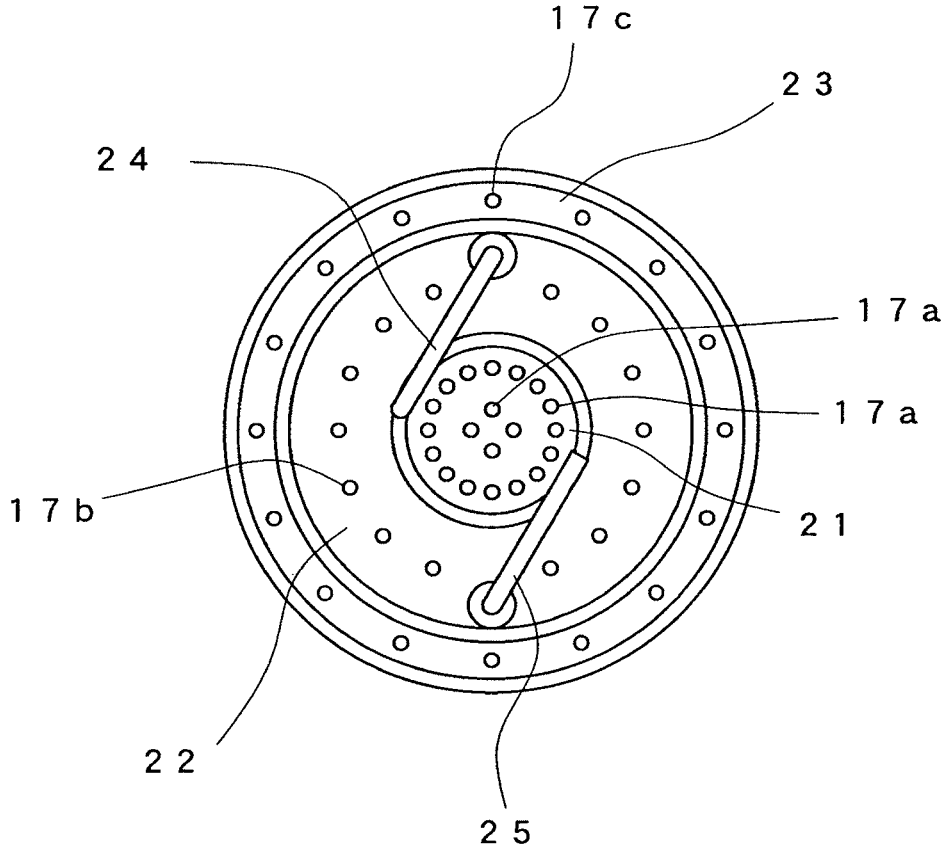
FIG. 2 is a diagram showing a flame plate of the present invention.

The premixed gas passage 18, the hydrogen-containing gas chamber 20 and the secondary air passage 16 are connected to the flame plate 17 provided with the plurality of perforating spout holes as shown in FIG. 2, and the burner part 2 is closed by the flame plate 17.

Out of the spout holes provided in the flame plate 17, a premixed gas spout hole 17*a* provided in a central part of the flame plate 17 is communicated with the premixed gas passage 18, and these flame holes configure a premixed gas deriving part 21 for deriving the premixed gas. Combustion mixed gas spouted out of this premixed gas deriving part 21 is ignited by an ignition device 24, whereby combustion is started.

A hydrogen-containing gas spout hole 17*b* provided around the premixed gas spout hole 17*a* is communicated with the hydrogen-containing gas chamber 20 and configures a hydrogen-containing gas deriving part 22 for deriving the hydrogen-containing gas.

Moreover, a secondary air spout hole 17*c* is provided in a peripheral part of the flame plate 17 so as to surround the hydrogen-containing gas spout hole 17*b*. This secondary air spout hole 17*c* is communicated with the secondary air passage 16 and configures a secondary air deriving part 23 for deriving the secondary air. Therefore, the air flowing from the air blowing passage 3 into the air supply chamber 10 is spouted out from the secondary air deriving part 23 and supplied, as the secondary air, to the flame formed in the premixed gas burner 14 and the hydrogen-containing gas burner 15.

The ignition device 24 and a flame detecting device 25 for detecting the combustion state are inserted into the secondary air passage 16 and penetrate through the flame plate 17 such that the tip ends thereof aim the premixed gas deriving part 21.

Next, the operations of the combustion apparatus according to the present embodiment having the abovementioned configurations are described.

First, when the operation of the fuel cell is instructed, electric conduction to the heater 5 is started to heat the vaporizer 1. When a sensor (not shown) detects that the temperature of the vaporizer 1 has reached the temperature at which the liquid fuel can be vaporized, an instruction to start supplying the liquid fuel to the vaporizer 1 is issued, whereby the liquid fuel is supplied to the vaporizer 1 through the liquid fuel supply tube 4.

The liquid fuel supplied to the vaporizer 1 falls onto the partition plate 7, spreads out evenly in all directions, and drip from a drip hole 8 onto the evaporating part 6. The liquid fuel that drips onto the evaporating part 6 is then heated and vaporized into the combustion gas, which disperses into the vaporizing chamber 9.

At this minute, some of the air supplied from the air blowing passage 3 to the air supply chamber 10 enters, as the primary air, the vaporizing chamber 9 from a gap of the liquid fuel supply pipe 4, and consequently the primary air is mixed with the combustion gas dispersing into the vaporizing chamber 9, to form the premixed gas.

This premixed gas flows from the inflow port 12 into the premixed gas spout part 11 and is spouted out from the spout port 13 to the premixed gas passage 18. Because the inflow port 12 is provided at a position higher than the evaporating part 6, the space serving as a tray for receiving the liquid fuel is formed between the evaporating part 6 and the inflow port 12. By accumulating unvaporized liquid fuel in this space, adequate time for completely vaporizing the liquid fuel can be provided, so that the unevaporated fuel in a liquid state can be prevented from flowing into the premixed gas spout part 11. In other words, the fuel contained in the premixed gas spouted out from the spout port 13 to the premixed gas passage 18 becomes the combustion gas that is completely vaporized, and the combustion state in the burner part 2 can be maintained well.

In addition, with the premixed gas spout part 11, the pressure within the vaporizing chamber 9 can be increased, and this pressure increase can reduce pressure fluctuation within the vaporizing chamber 9, which is caused as the liquid fuel evaporates. Hence, fluctuation of the combustion capacity is prevented, and the combustion gas and the primary air are mixed sufficiently. As a result, the premixed gas to be spouted out becomes even.

It should be noted that, that in order to obtain the abovementioned effects, the hole length of the premixed gas spout part 11 is made greater than the diameter of the spout port 13 and preferably at least double the diameter of the spout port 13.

The premixed gas is then spouted out from the premixed gas deriving part 21 provided in the central part of the flame plate 17 through the premixed gas passage 18, and ignited by the ignition device 24, whereby combustion is started in the premixed gas burner 14.

In so doing, the secondary air is spouted out from the secondary air deriving part 23. The secondary air is supplied to the vicinity of an end of the flame formed by the combustion of the premixed gas, whereby the premixed gas is combusted completely. Furthermore, the combustion state of the premixed gas burner 14 is monitored by the flame detecting device 25.

Because the premixed gas spout part 11, the premixed gas burner 14 (premixed gas passage 18) and the premixed gas deriving part 21 are disposed coaxially, not only is it possible to configure the combustion apparatus compactly, but also the premixed gas can be combusted with a well-balanced flame distribution. An additional effect is that the heating efficiency of the heater 5 can be enhanced, as the heat concentrates in a central axis direction.

By combusting the premixed gas in this manner, the reforming apparatus is heated. Then, when the temperature of the reforming apparatus increases to an activating temperature, the hydrogen-based modified gas is generated from kerosene that is raw fuel such as hydrocarbon. This hydrogen-based modified gas is supplied to the fuel cell to activate the fuel cell, whereby power-generating operation of the fuel cell is started.

At the time of the power-generating operation of the fuel cell, the entire hydrogen-based modified gas supplied to the fuel cell is not consumed in power generation, but the hydrogen-based modified gas is discharged from the hydrogen electrode of the fuel cell, as the hydrogen-containing gas that still contains approximately several tens percent of unreacted hydrogen gas. This hydrogen-containing gas is also used in combustion performed by the combustion apparatus.

Specifically, the hydrogen-containing gas discharged from the hydrogen electrode is supplied to the hydrogen-containing gas chamber 20 through the hydrogen-containing gas supply tube 19 and spouted out from the hydrogen-containing gas deriving part 22. As a result, the hydrogen-containing gas is ignited by coming into contact with the flame that is already formed in the premixed gas deriving part 21, and is combusted, whereby combustion is started by both the premixed gas and the hydrogen-containing gas.

Both of the flames are completely combusted by taking in the secondary air supplied from the secondary air deriving part 23, and continues to heat the reforming apparatus. The premixed gas deriving part 21 and the hydrogen-containing gas deriving part 22 are provided on the same flame plate 17. Because the distance therebetween is small, the hydrogen-containing gas spouted out from the hydrogen-containing gas deriving part 22 is ignited by surely coming into contact with the flame.

Incidentally, immediately after the reforming apparatus is activated, supply of the hydrogen-based reforming gas to the fuel cell is not stable. Therefore, the amount of the hydrogen-containing gas discharged from the fuel cell is also unstable. Because it is difficult to maintain stable combustion by means of the hydrogen-containing gas alone, combustion using both the premixed gas and the hydrogen-containing gas is continued for a while after the activation of the reforming apparatus.

Once the combustion of the hydrogen-containing gas is stabilized, supply of the liquid fuel to the vaporizer 1 is stopped, and combustion using the hydrogen-containing gas alone begins. Note that the amount of the hydrogen-containing gas is affected by an output of the fuel cell. Therefore, at the time of combustion using the hydrogen-containing gas burner 15 alone, in a case where the output of the fuel cell is low and the amount of the hydrogen-containing gas to be discharged is also low, a shortage in combustion capacity occurs, and the temperature required for activating the reforming apparatus is no longer maintained. Thus, when the temperature of the reforming apparatus that is detected by the sensor (not shown) reaches a predetermined value or lower, the liquid fuel is supplied to the vaporizer 1 again to generate the premixed gas, and both the premixed gas and the hydrogen-containing gas are combusted to heat the reforming apparatus.

What is claimed is:

1. A combustion apparatus, comprising:

a heater for heating a vaporizer;

an evaporating part for heating and vaporizing liquid fuel into combustion gas;

a vaporizing chamber for mixing the combustion gas with primary air to obtain premixed gas;

a premixed gas spout part communicated with the vaporizing chamber and having an inflow port and spout port; and a burner part provided vertically below the vaporizer and combusting the premixed gas, wherein the evaporating part is provided on an inner bottom surface of the vaporizing chamber, the premixed gas spout part extends into the vaporizing chamber such that the inflow port of the premixed gas spout part is positioned at a higher position than the evaporating part, and wherein a hole length of the premixed gas spout part is larger than a diameter of the inflow port.

2. The combustion apparatus according to claim 1, wherein the premixed gas spout part and the burner part are arranged coaxially.

3. The combustion apparatus according to claim 1, further comprising a hydrogen-containing gas supply tube for supplying hydrogen-containing gas, wherein the burner part combusts the premixed gas and the hydrogen-containing gas.

4. The combustion apparatus according to claim 3, wherein the burner part has a flame plate that has, at the center thereof, a premixed gas spout hole for spouting out the premixed gas, a hydrogen-containing gas spout hole for spouting out the hydrogen-containing gas to an outer circumference of the premixed gas spout hole, and a secondary air spout hole for spouting out secondary air to an outer circumference of the hydrogen-containing gas spout hole.

5. The combustion apparatus according to claim 1, wherein the evaporating part vaporizes the liquid fuel dropped on the inner bottom surface of the vaporizing chamber.

* * * * *